US007698861B2

(12) United States Patent
Bogue

(10) Patent No.: US 7,698,861 B2
(45) Date of Patent: Apr. 20, 2010

(54) MASONRY BLOCK WALL BRACING WALL ANCHOR

(76) Inventor: Richard A. Bogue, 3310 Brampton Way, Boise, ID (US) 83706

( * ) Notice: Subject to any disclaimer, the term of this patent is extended or adjusted under 35 U.S.C. 154(b) by 47 days.

(21) Appl. No.: 11/716,351

(22) Filed: Mar. 9, 2007

(65) Prior Publication Data

US 2008/0216433 A1 Sep. 11, 2008

(51) Int. Cl.
*E04B 1/16* (2006.01)
*E04B 1/38* (2006.01)
*E04B 1/62* (2006.01)

(52) U.S. Cl. ..... 52/379; 52/565; 52/712; 52/513

(58) Field of Classification Search ..... 52/127.2, 52/127.3, 127.5, 749.1, 98, 99, 712, 713, 52/513; 248/354.1, 354.2, 354.3, 304; 411/5, 411/400, 401
See application file for complete search history.

(56) References Cited

U.S. PATENT DOCUMENTS 592,506 A * 10/1897 Beaton ..... 248/59
1,037,142 A * 8/1912 Hazen ..... 52/709
1,963,514 A * 6/1934 Wherren ..... 249/42
2,406,559 A * 8/1946 Oakes ..... 52/99
2,805,105 A * 9/1957 Brasher ..... 403/258
2,832,559 A 4/1958 Hillberg
2,874,603 A * 2/1959 Boettcher ..... 411/482
3,005,292 A * 10/1961 Reiland ..... 52/99
3,229,950 A 1/1966 MacRobbie
3,552,734 A * 1/1971 Severino et al. ..... 269/287
3,744,208 A * 7/1973 Spanel ..... 52/706
3,843,080 A * 10/1974 Imai et al. ..... 248/58
3,874,625 A 4/1975 Hansen
4,079,556 A 3/1978 Luck
4,083,156 A 4/1978 Tye
4,279,190 A * 7/1981 Hummel ..... 411/487
4,512,121 A * 4/1985 Carydias et al. ..... 52/125.2
4,872,298 A * 10/1989 Klemic, Jr. ..... 52/127.1
4,872,634 A 10/1989 Gillaspy
D317,860 S * 7/1991 Gary ..... D8/373
5,050,364 A * 9/1991 Johnson et al. ..... 52/705
5,337,534 A * 8/1994 Nasca ..... 52/745.21
5,660,006 A 8/1997 Emerson
5,743,678 A * 4/1998 Pitre ..... 405/259.1
5,794,394 A * 8/1998 Bill et al. ..... 52/295
5,956,906 A 9/1999 Berich et al.
6,345,472 B1 * 2/2002 Taylor ..... 52/125.4
6,401,406 B1 * 6/2002 Komara ..... 52/127.3

(Continued)

*Primary Examiner*—Richard E Chilcot, Jr.
*Assistant Examiner*—Jessica Laux
(74) *Attorney, Agent, or Firm*—Charles R. Clark

(57) ABSTRACT

A masonry block wall bracing wall anchor having a threaded portion connected to an intermediate portion of the wall anchor with the intermediate portion having a vertical cross-section generally sized to fit between and substantially bridge the vertical thickness of a bed joint between two successive courses of masonry blocks and the threaded portion available for connecting by means of a washer and a nut to a side support that braces a masonry block wall during construction. The preferred embodiment has an upper transverse fracture groove and a lower transverse fracture groove through which after completion of the wall selectively can propagate a fracture line when the masonry block wall is completed. The fracture grooves can facilitate selective fracturing of the wall bracing wall anchor thereby allowing removal of a protruding threaded portion of the anchor that extends beyond the outer face of the masonry wall.

6 Claims, 7 Drawing Sheets

U.S. PATENT DOCUMENTS 6,854,222 B2 2/2005 Hansort
6,868,647 B2 * 3/2005 Poldmaa ..... 52/749.12
6,908,275 B2 * 6/2005 Nelson et al. ..... 411/487
6,955,346 B2 * 10/2005 Anderson ..... 269/303
7,103,984 B2 * 9/2006 Kastberg ..... 33/562
7,174,689 B2 * 2/2007 Alyea et al. ..... 52/700
7,182,566 B1 * 2/2007 Nelson et al. ..... 411/487
2005/0016114 A1 * 1/2005 Thompson ..... 52/698
2006/0001284 A1 * 1/2006 Stephenson ..... 296/1.08

* cited by examiner

MASONRY BLOCK WALL BRACING WALL ANCHOR

CROSS-REFERENCE TO RELATED APPLICATIONS

Not applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

In modern society, efforts are ongoing to safeguard construction sites to prevent injuries to workers and lessen damage to components of the construction project. Often during its construction, a masonry block wall 2 on a construction site is braced by one or more angled side supports 28 to prevent lateral movement and potential collapse of the wall to the side.

A commonly used wall anchor in a bed joint 12 of a masonry block wall 2 for attaching of an angled side support 28 is a J-bolt wall anchor 18 having a threaded portion 20 joined to an intermediate cylindrical portion 22 that in turn is joined to an angled cylindrical portion 24. The j-bolt wall anchor 18 often has a diameter greater than the vertical thickness of the bed joint 12 between two successive courses of masonry block 4 with each block having one or more vertical cells 6; and in such instances, the j-bolt wall anchor is often placed in and through a mason enlarged portion of the bed joint with the angled cylindrical portion 22 retained within a hollow vertical cell of a block by a cementious mixture or a concrete aggregate slurry that is poured into a group of substantially vertically aligned vertical cells of a plurality of successive courses of masonry blocks and with the threaded portion protruding perpendicularly through the enlarged portion of the bed joint and extending outwardly sufficiently from an outer face of the wall for attaching to an upper wall mounting bracket 30 of an angled side support 28 by means of a washer 38 and a nut 40. The mason enlarged portion of the bed joint 12 includes an anchor receiving channel 10 chipped with a mason's hammer or other suitable tool in the lower edge of an overlying channeled masonry block 8 or chipped in the upper edge of an underlying masonry block to provide clearance in the channel and the bed joint for the emplacement of the intermediate cylindrical portion 22 of the j-bolt wall anchor 18.

Often a job specification for a masonry wall under construction requires the emplacing of one or more vertical rebar members 16 vertically through and within a group of one or more substantially vertically aligned vertical cells 6 of a plurality of successive courses of masonry blocks with the rebar members secured therein by a cementious mixture or a concrete aggregate slurry that is poured into the aligned vertical cells and that encircles the rebar members.

Often after the wall 2 is built, the mason or another worker is required to remove the J-bolt wall anchor 18 from the wall or to cut off the protruding threaded portion 20 of the J-bolt wall anchor with either process likely resulting in some damage to the wall that then must be repaired. Under the prior art, often the j-bolt wall anchor 18 would be cut off by a worker using an acetylene torch or using a powered hot saw resulting in damage to the wall that then would require significant labor time and expense to fix.

An object of the invention is to provide a masonry block wall bracing wall anchor that when the wall is completed can have its protruding threaded end portion quickly broken off by use of a simple hand tool such as a mason's hammer or a small sledge hammer with little or no damage resulting to the outer face of the wall. Use of the present invention a masonry block wall bracing wall anchor in the construction of a masonry block wall can save labor time and expense especially during removal of the protruding portions of the invention after the wall is completed over the labor time and expense necessary to remove or cut off the protruding portions of prior art wall anchors such as j-bolt wall anchors.

BRIEF SUMMARY OF THE INVENTION

The present invention is an improved block wall bracing wall anchor 42', 54, 68, 82, or 98 each respectively having a threaded end portion 44, 56, 70, 84, or 100 that after a wall 2 is completed can be broken off flush to or recessed in from an outer face of the wall and that is more convenient and easier to use than prior art wall anchors such as j-bolt wall anchors.

A principal objective of the improved masonry block wall bracing wall anchor is to help a mason or other person who during construction of a masonry block wall braces the wall using one or more side supports each attached respectively to a masonry block wall bracing wall anchor to more easily remove a protruding threaded end portion of each wall anchor once the wall is completed.

The invention also is designed to save time and labor during the building of the wall. When emplacing the invention in a bed joint, the mason does not need to make an anchor receiving channel in any of the masonry blocks placed in the wall because the portion of the invention that is retained in the bed joint is thinner than the vertical thickness of the bed joint.

A further object of the invention is making available to masons or other users, a masonry block wall bracing wall anchor that is durable, easy to use, easy to secure in a block wall, and is inexpensive to manufacture.

The invention is a masonry block wall bracing wall anchor designed principally for emplacement in and through a bed joint of a masonry block wall; the bracing wall anchor has a threaded end portion connected to an intermediate portion with the intermediate portion having a vertical cross-section generally sized to fit between and substantially bridge the vertical thickness of a bed joint between two successive courses of masonry blocks in a masonry block wall and the threaded end portion is available for connecting by means of a washer and a nut to a side support that braces the masonry block wall during construction.

The preferred embodiment of the wall anchor invention has an upper transverse fracture groove and a lower transverse fracture groove through which after completion of the wall, a mason or other worker by means of a hammer or other suitable tool can selectively propagate a fracture line thereby splitting the wall anchor into two major pieces.

After construction of the wall is completed, the fracture grooves can facilitate selective fracturing of the wall bracing wall anchor thereby allowing removal of a protruding threaded portion of the anchor that extends beyond the outer face of the masonry wall.

Additional and various other objects and advantages attained by the invention will become more apparent as the specification is read and the accompanying figures are reviewed.

DETAILED DESCRIPTION OF THE INVENTION

Referring to FIGS. 1 through 27, the present invention is a novel improved masonry block wall bracing wall anchor 42, 42', 54, 68, 82, or 98.

Figure 1:
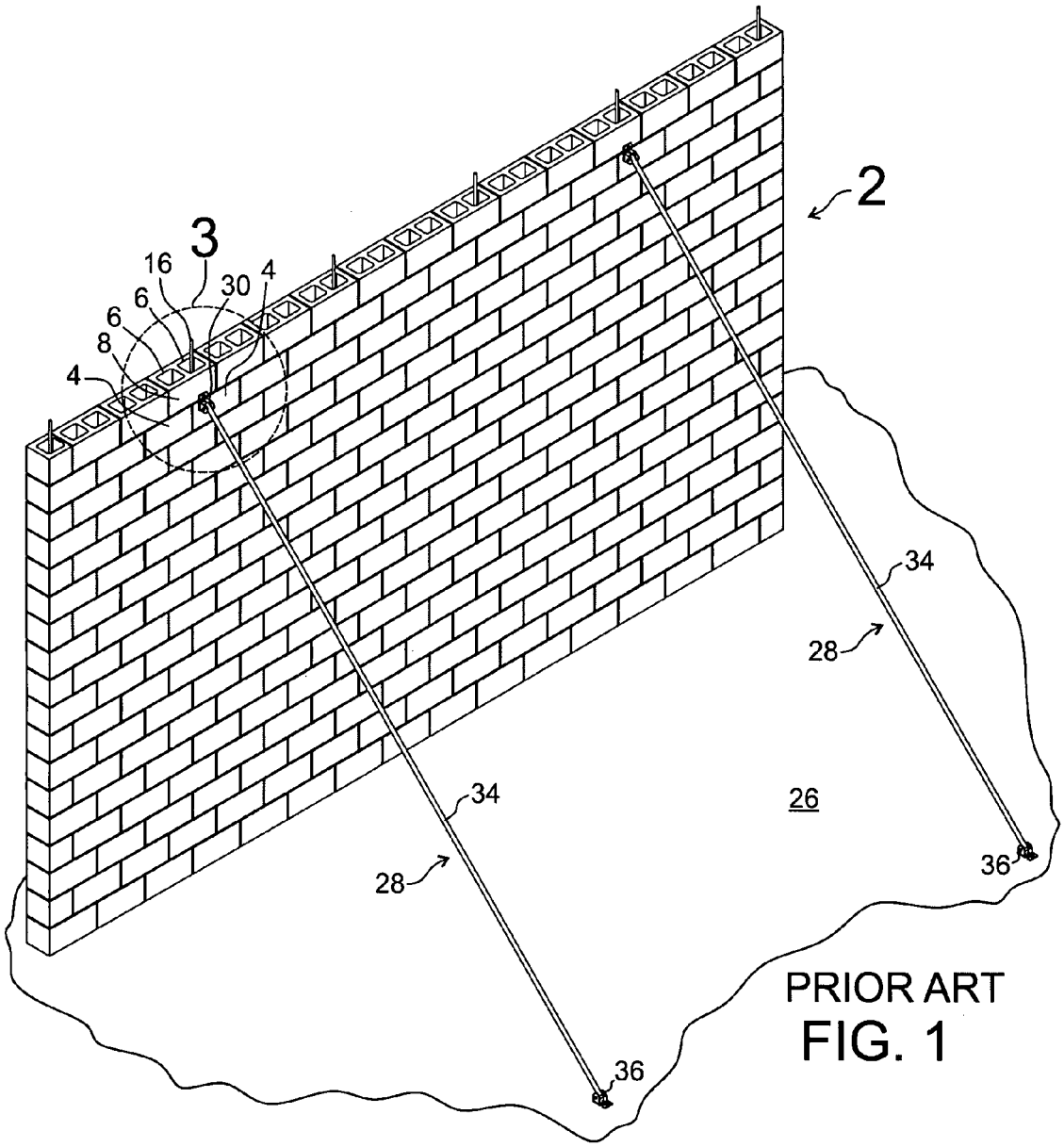
PRIOR ART FIG. 1
FIG. 1 is a perspective view of a prior art masonry block wall 2 having two prior art angled side supports 28 attached.
Figure 2:
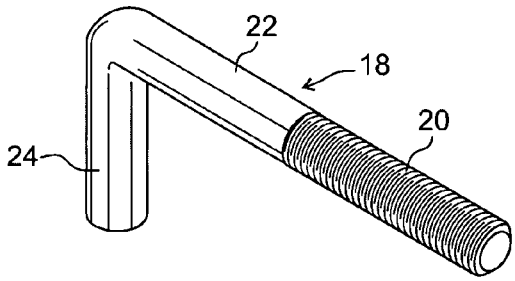
PRIOR ART FIG. 2
FIG. 2 is a perspective view of a prior art j-bolt wall anchor 18.
Figure 3:
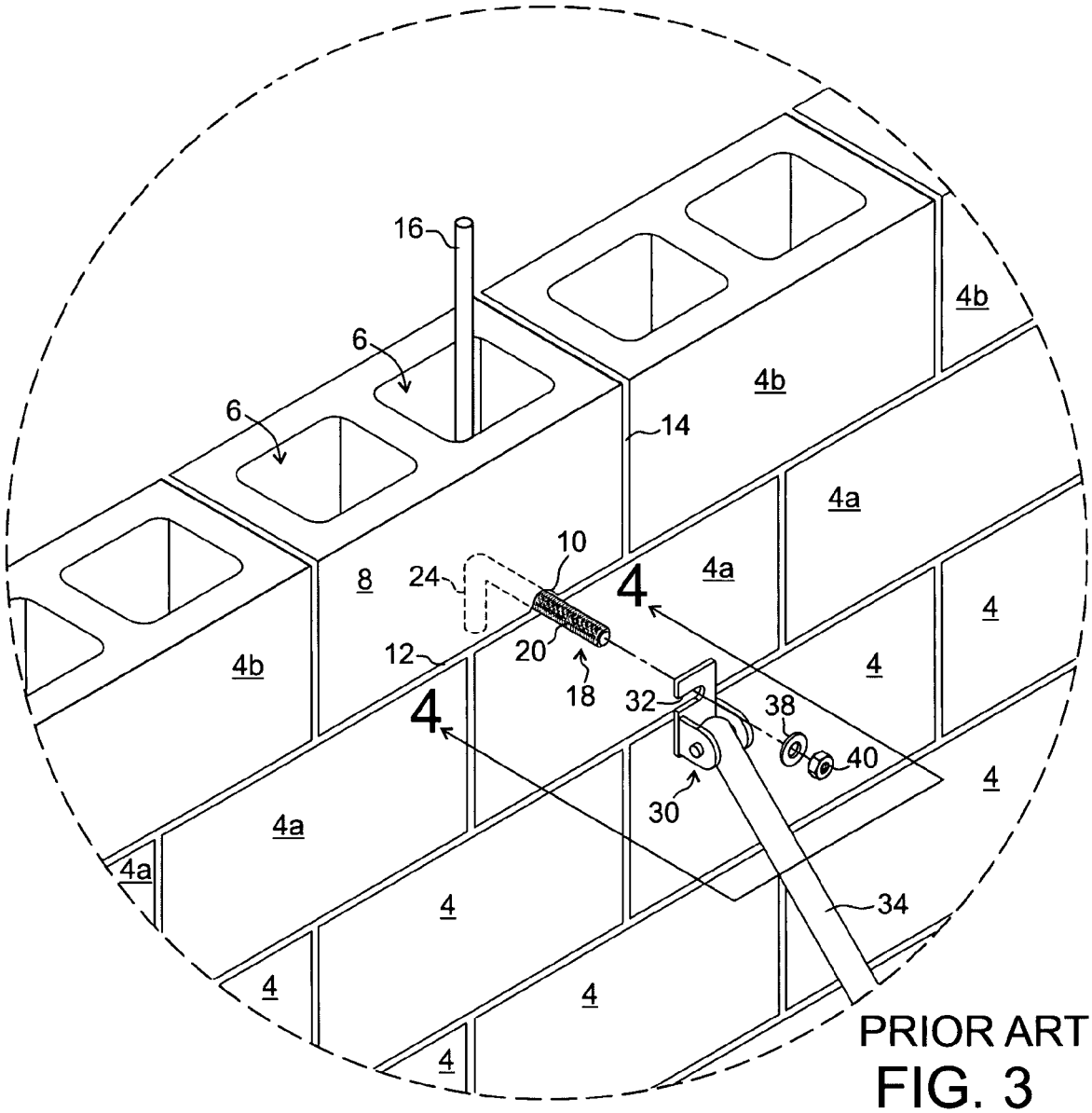
PRIOR ART FIG. 3
FIG. 3 is an enlarged, partially exploded, partial view of the prior art masonry block wall 2 as indicated in FIG. 1 showing the placement of a prior art j-bolt wall anchor 18 in and through an enlarged portion of a bed joint 12 of the wall and the j-bolt wall anchor's cooperating relationship with an upper wall mounting bracket 30 of the side support 28, a washer 38, and a nut 40.

Referring to FIGS. 1 and 3, a masonry block wall 2 under the prior art could be braced against sideward movement by one or more angled side supports 28 removably attached between the wall and a floor slab 26 or other suitable footing with each support having an upper wall mounting bracket 30 pivotally linked to an intermediate telescopically adjustable assembly 34 that in turn is pivotally linked to a lower mounting bracket 36 and the lower mounting bracket removably attached to the floor slab or other suitable footing. FIG. 2 shows a prior art j-bolt wall anchor 18 having a threaded portion 20 joined to an intermediate cylindrical portion 22 that in turn is joined to an angled cylindrical portion 24.

Figure 4:
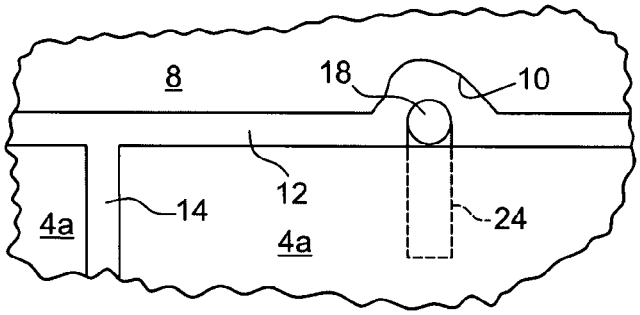
PRIOR ART FIG. 4
FIG. 4 is a partial view of the prior art masonry wall 2 as viewed from direction 4-4 in FIG. 3 with the upper wall mounting bracket, the side support, the washer, and the nut not shown and showing a prior art channeled masonry block 8 having an anchor receiving channel 10 resulting in the enlarged portion of the bed joint 12.

FIGS. 3 and 4 each shows a portion of a masonry block wall 2 having at least one bed joint 12 and at least one head joint 14 and each shows a j-bolt wall anchor 18 in a bed joint 12 of the wall and each shows the j-bolt wall anchor protruding into an anchor receiving channel 10 of a channeled masonry block 8 that replaces one relative succeeding upper course masonry block 4*b*. FIG. 4 also shows the j-bolt wall anchor 18 resting on the upper edge of a relative lower course masonry block 4*a*.

FIG. 3 also shows in a partially exploded view how the threaded portion 20 can be used with a washer 38 and nut 40 to clamp an upper wall mounting bracket 30 of the side support 28 to the wall 2 by placing the threaded portion in and through a receiving slot 32 of the upper wall mounting bracket and by engaging and tightening of the washer and nut onto the threaded portion.

Figure 5:
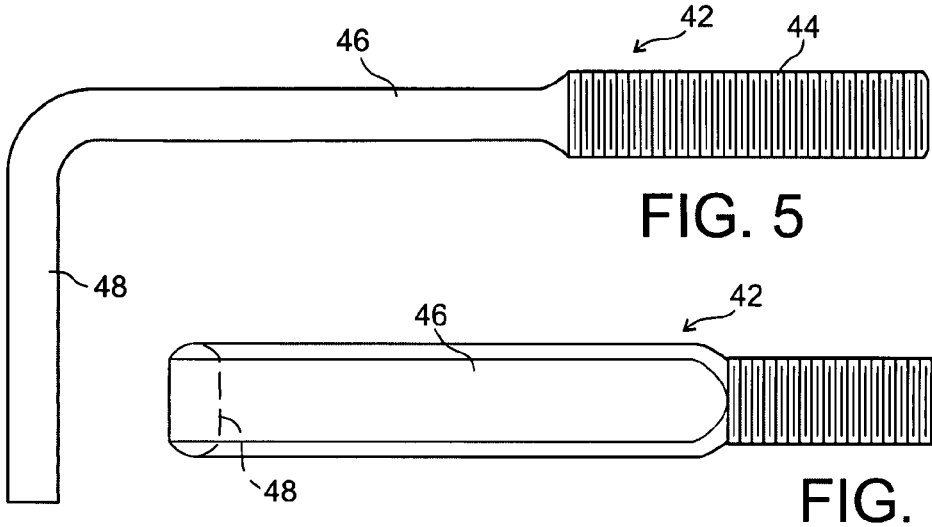
FIG. 5 is a side view of a first embodiment 42 of the present invention, a block wall bracing wall anchor.
Figure 6:
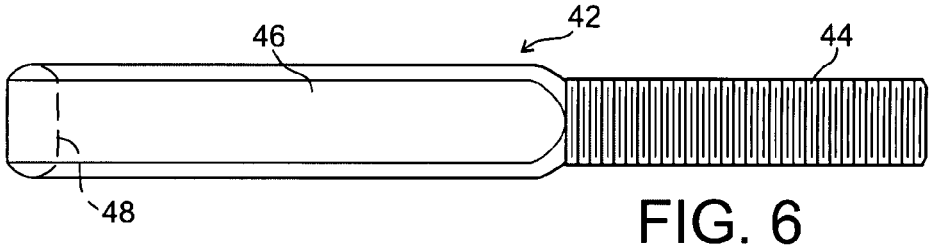
FIG. 6 is a top view of the first embodiment 42 of the block wall bracing wall anchor.

FIG. 5 shows a first embodiment 42 of a masonry block wall bracing anchor that is intended for emplacing in a masonry block wall 2 preferably in and through a bed joint 12 of the masonry block wall and removably attached by a washer and a nut to a side support such as an upper wall mounting bracket 30 of a prior art side support 28. The first embodiment 42 preferably is formed by forging and rolling from rod stock of low to mid-grade steel, but alternatively the embodiment could be machined from appropriate stock material. The first embodiment 42 has a threaded end portion 44, preferably having rolled threads, joined to an intermediate body portion 46 having flat and parallel upper and lower surfaces and preferably having a cross-sectional width greater than the diameter of the threaded end portion and a cross-sectional thickness less than the diameter of the threaded end portion, and the intermediate body portion joined to an opposite end portion 48. The first embodiment 42 is intended for use as a masonry block wall bracing wall anchor for emplacing within a masonry block wall 2 having a plurality of bed joints 12 between two successive courses of masonry blocks for the attaching of a side support 28.

The first embodiment 42 comprises a threaded end portion 44 joined to an intermediate body portion 46 having a vertical cross-section generally sized to fit within and substantially bridge the vertical thickness of a bed joint between two successive courses of masonry blocks in a masonry block wall, said intermediate body portion having flat and parallel upper and lower surfaces, and said intermediate body portion joined to an opposite end portion 48. Preferably, the opposite end portion 48 is angled away from the longitudinal axis of the intermediate body portion 46.

Figure 7:
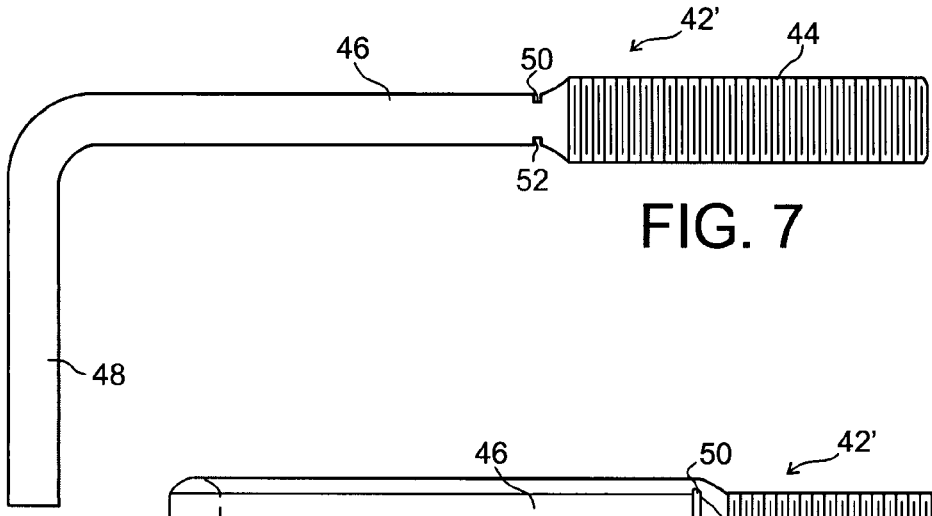
FIG. 7 is a side view of a second embodiment 42' of the block wall bracing wall anchor.
Figure 8:
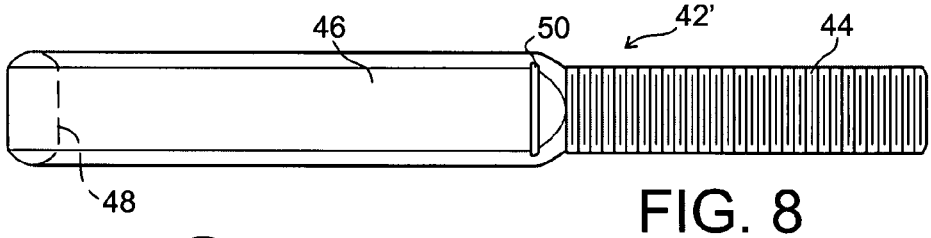
FIG. 8 is a top view of the second embodiment 42' of the block wall bracing wall anchor.
Figure 9:
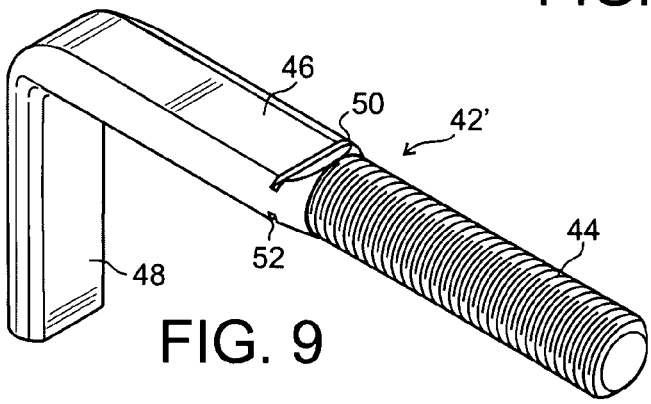
FIG. 9 is a perspective view of the second embodiment 42' of the block wall bracing wall anchor.
Figure 10:
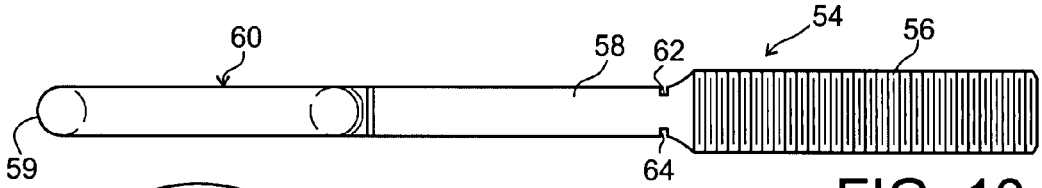
FIG. 10 is a side view of a preferred third embodiment 54 of the block wall bracing wall anchor.
Figure 11:
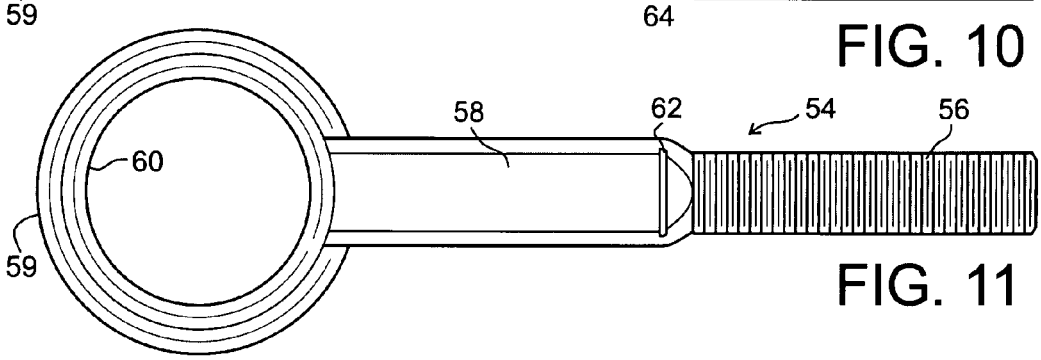
FIG. 11 is a top view of the preferred third embodiment 54 of the block wall bracing wall anchor.
Figure 13A:
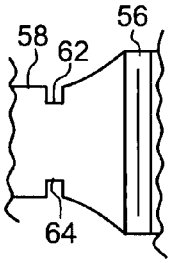
FIG. 13A is a partial side view of the preferred third embodiment 54 of the block wall bracing wall anchor showing a side profile for squared fracture grooves 62 and 64.
Figure 12:
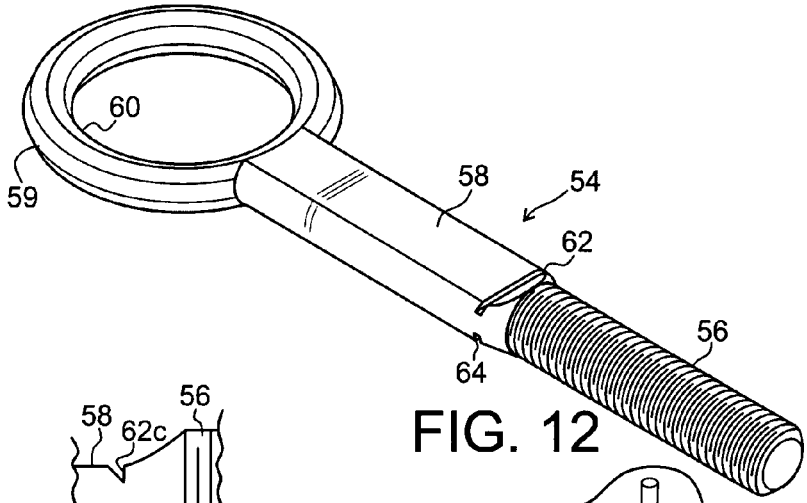
FIG. 12 is a perspective view of the preferred third embodiment 54 of the block wall bracing wall anchor.
Figure 13B:
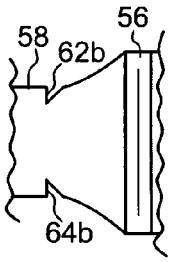
FIG. 13B is a partial side view of the preferred third embodiment 54 of the block wall bracing wall anchor showing an alternative side profile for skewed left V-shaped fracture grooves 62*b* and 64*b;*
Figure 13C:
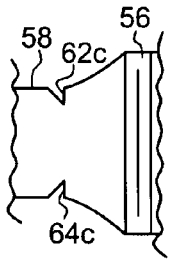
FIG. 13C is a partial side view of the preferred third embodiment 54 of the block wall bracing wall anchor showing an alternative side profile for skewed right V-shaped fracture grooves 62*c* and 64*c;*
Figure 13D:
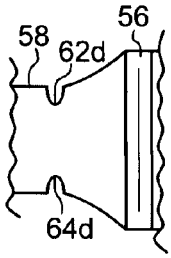
FIG. 13D is a partial side view of the preferred third embodiment 54 of the block wall bracing wall anchor showing an alternative side profile for U-shaped fracture grooves 62*d* and 64*d;*
Figure 13E:
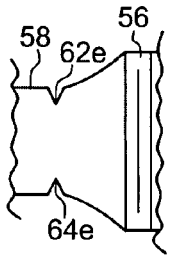
FIG. 13E is a partial side view of the preferred third embodiment 54 of the block wall bracing wall anchor showing an alternative side profile for symmetrical V-shaped fracture grooves 62*e* and 64*e;*

As shown in FIGS. 7, 8, and 9, a second embodiment 42' of a masonry block wall bracing wall anchor comprises a threaded end portion 44 joined to an intermediate body portion 46 having a vertical cross-section generally sized to fit within and substantially bridge the vertical thickness of a bed joint between two successive courses of masonry blocks in a masonry block wall, said intermediate body portion having flat and parallel upper and lower surfaces, said intermediate body portion 46 having an upper transverse fracture groove 50 in said upper surface located near said threaded end portion and having a lower transverse fracture groove 52 in said lower surface located closest to, opposite to, and parallel to said upper transverse fracture groove, and said intermediate body portion joined to an opposite end portion 48. Preferably, the opposite end portion 48 is angled away from the longitudinal axis of the intermediate body portion 46. Preferably, the threaded end portion 44 has a diameter greater than the thickness of said intermediate body portion 46. The second embodiment 42' preferably is formed by forging and rolling from rod stock of low to mid-grade steel, but alternatively the embodiment could be machined from appropriate stock material. Also preferably, the intermediate body portion 46 is swaged down by forging from cylindrical stock having the same diameter as the contiguous threaded end portion 44 to a cross-sectional width of the body portion greater than the diameter of the threaded end portion.

A preferred third embodiment 54 of the masonry block wall bracing wall anchor is shown in FIGS. 10 through 17. In the third embodiment, a masonry block wall bracing wall anchor 54 comprises a threaded end portion 56 joined to an intermediate body portion 58 having a vertical cross-section generally sized to fit within and substantially bridge the vertical thickness of a bed joint between two successive courses of masonry blocks in a masonry block wall, said intermediate body portion having flat and parallel upper and lower surfaces, said intermediate body portion having an upper transverse fracture groove 62 in said upper surface located near said threaded end portion and having a lower transverse fracture groove 64 in said lower surface located closest to, opposite to, and parallel to said upper transverse fracture groove, said intermediate body portion joined to an opposite end portion 59, and said opposite end portion having an eye 60 preferably sized to receive through it at least one rebar member such as a vertical rebar member 16. Preferably, the intermediate body portion 58 has a thickness less than the diameter of said threaded end portion 56. The third embodiment 54 preferably is formed by forging and rolling from rod stock of low to mid-grade steel, but alternatively the embodiment could be machined from appropriate stock material. Also preferably, the intermediate body portion 58 is swaged down by forging from cylindrical stock having the same diameter as the contiguous threaded end portion 56 to a cross-sectional width of the body portion greater than the diameter of the threaded end portion.

FIGS. 13A through 13E illustrate alternative side profiles for fracture grooves 62, 62*b*, 62*c*, 62*d*, or 62*e* and alternative side profiles for fracture grooves 64, 64*b*, 64*c*, 64*d*, or 64*e*.

Figure 14:
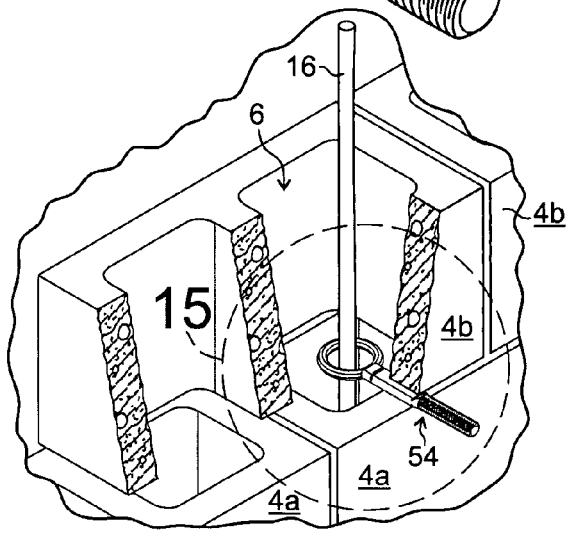
FIG. 14 is a partial perspective view of a masonry block wall showing the preferred third embodiment 54 of the block wall bracing wall anchor bracketed between an upper edge of a relative lower course masonry block 4*a* and a lower edge of a relative succeeding upper course masonry block 4*b;*

FIG. 14 is a partial perspective view of a masonry block wall showing the preferred third embodiment 54 of the masonry block wall bracing wall anchor bracketed between an upper edge of a relative lower course masonry block 4*a* and a lower edge of a relative succeeding upper course masonry block 4*b*. FIGS. 14 to 17 illustrate the preferred placing of the masonry block wall bracing wall anchor 54 in a masonry block wall with the fracture grooves 62 and 64 parallel to and bracketing the plane of an outer face of the wall through which the anchor protrudes.

To enable better understanding of the invention, FIGS. 1, 3, 4, 14, 15, 16, 17, and 26 do not show the mortar between the joints of the various walls and do not show the cementious mixture or the concrete aggregate slurry that would be poured into a number of the substantially vertically aligned cells.

Figure 15:
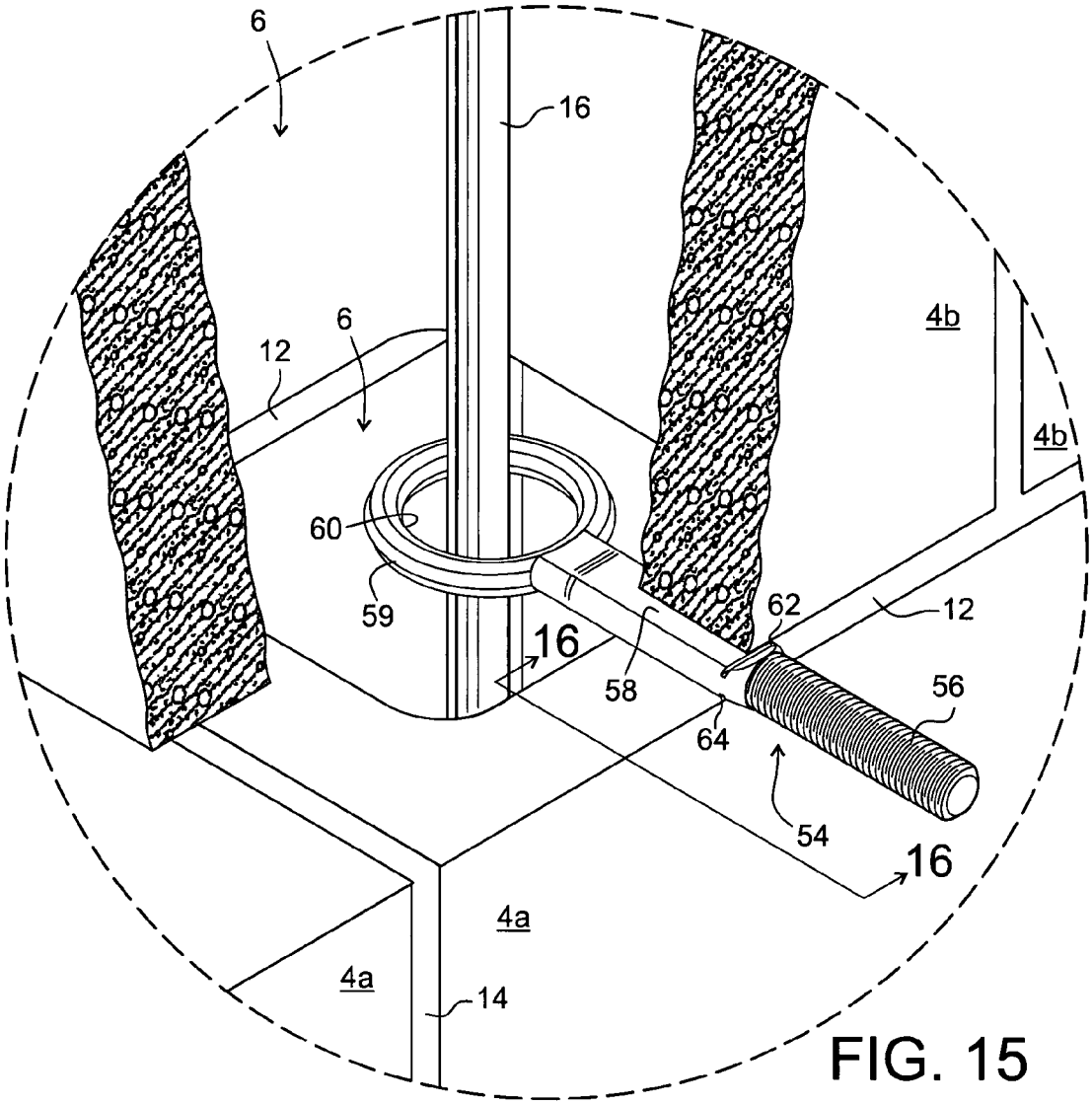
FIG. 15 is an enlarged, partial view of the masonry block wall as indicated in FIG. 14 showing the placement of a bracing wall anchor 54 in and through a bed joint 12 of the wall and showing a vertical rebar member 16 threaded through an eye 60 of the bracing wall anchor.

FIG. 15 is an enlarged, partial view of the masonry block wall as indicated in FIG. 14 showing the placement of a bracing wall anchor 54 in and through a bed joint 12 of the wall and showing a vertical rebar member 16 threaded through an eye 60 of the bracing wall anchor.

Figure 16:
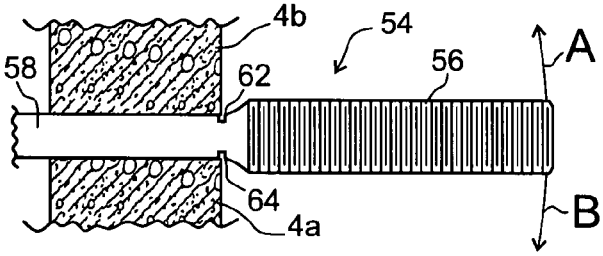
FIG. 16 is a partial sectional view of the masonry wall and the bracing wall anchor 54 as viewed from direction 16-16 in FIG. 15 illustrating with two arrows A and B the upward and downward directions that when the wall is completed can be applied by a worker to a hammer (not shown) in striking an outer free end of a threaded end portion 56 to fracture the wall anchor through the fracture grooves 62 and 64 into two pieces.

FIG. 16 is a partial sectional view of the masonry wall and the bracing wall anchor 54 as viewed from direction 16-16 in FIG. 15 illustrating with two arrows A and B the upward and downward directions of movement that when the wall is completed can be imparted alternately by a worker to a hammer (not shown) in striking an outer free end of a threaded end portion 56 to fracture the wall anchor through the fracture grooves 62 and 64 into two pieces.

In FIG. 16, the arrow A also illustrates the potential upward direction of movement of the outer end of the threaded end portion 56 during a breaking process of the intermediate body portion 58 through the fracture grooves 62 and 64. In FIG. 16, the arrow B also illustrates the potential downward direction of movement of the outer end of the threaded end portion 56 during a breaking process of the intermediate body portion 58 through the fracture grooves 62 and 64.

Figure 17:
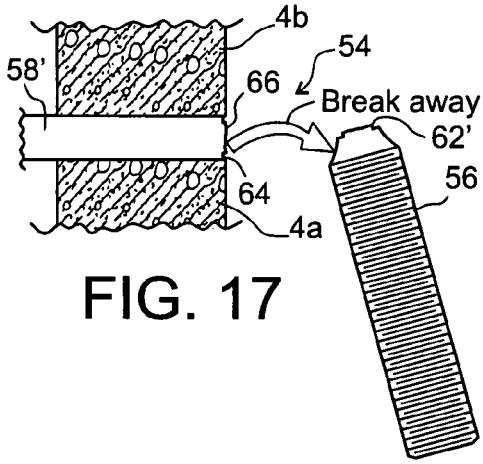
FIG. 17 is a partial sectional view of the masonry wall and the bracing wall anchor 54 as viewed from direction 16-16 in FIG. 15 showing the threaded end portion 56 broken off.

FIG. 17 is a partial sectional view of the masonry wall and the bracing wall anchor 54 as viewed from direction 16-16 in FIG. 15 showing a broken face 66 of the fractured body portion 58' retained within the wall and an edge of fractured face 62' in the upper transverse fracture groove 62 of the fractured body portion split away from the wall after a mason or other worker has broken off with a hammer or other suitable tool the protruding portion of the anchor that includes the threaded end portion 56.

Figure 18:
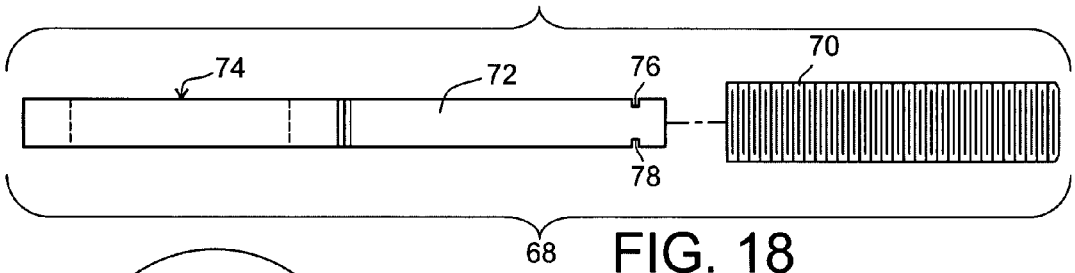
FIG. 18 is an exploded side view of a fourth embodiment 68 of the wall bracing wall anchor.
Figure 19:
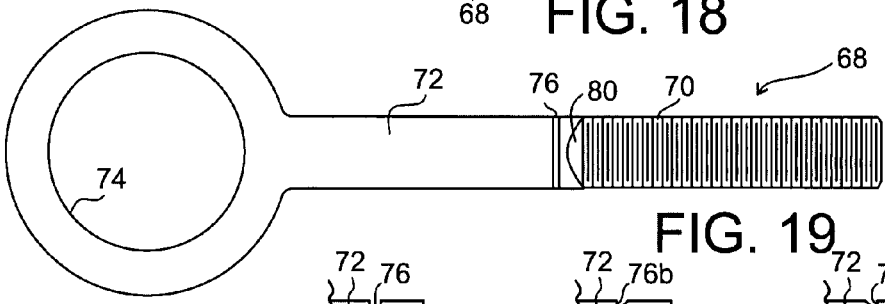
FIG. 19 is a top view of the fourth embodiment 68 of the wall bracing wall anchor.
Figure 21A:
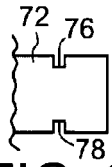
FIG. 21A is a partial side view of the fourth embodiment 68 of the block wall bracing wall anchor showing a side profile for squared fracture grooves 76 and 78.
Figure 21B:
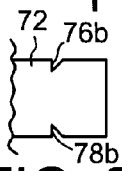
FIG. 21B is a partial side view of the fourth embodiment 68 of the block wall bracing wall anchor showing an alternative skewed left V-shaped fracture grooves 76*b* and 78*b* side profile.
Figure 21C:
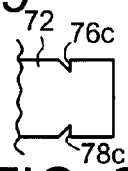
FIG. 21C is a partial side view of the fourth embodiment 68 of the block wall bracing wall anchor showing an alternative skewed right V-shaped fracture grooves 76*c* and 78*c* side profile.
Figure 20:
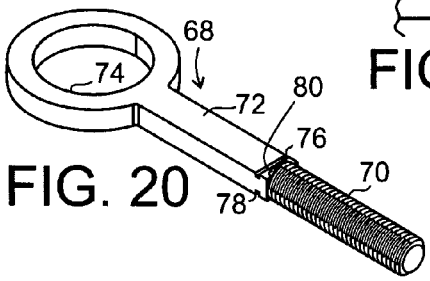
FIG. 20 is a perspective view of the fourth embodiment 68 of the block wall bracing wall anchor.
Figure 21D:
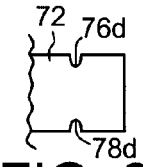
FIG. 21D is a partial side view of the fourth embodiment 68 of the block wall bracing wall anchor showing an alternative U-shaped fracture grooves 76*d* and 78*d* side profile.
Figure 21E:
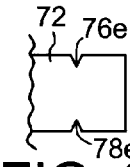
FIG. 21E is a partial side view of the fourth embodiment 68 of the block wall bracing wall anchor showing an alternative symmetrical V-shaped fracture grooves 76*e* and 78*e* side profile.

FIG. 18 is an exploded side view of a fourth embodiment 68 of the wall bracing wall anchor illustrating that the masonry block wall bracing wall anchor can be fabricated in part from plate steel. The fourth embodiment 68 comprises a threaded end portion 70 joined to a first end of a plate body portion 72, said plate body portion having flat and parallel upper and lower surfaces, having a thickness less than the diameter of said threaded end portion, having an upper transverse fracture groove 76 in and across said upper surface located near to and perpendicular to said threaded end portion, having a lower transverse fracture groove 78 in said lower surface located closest to, opposite to, and parallel to said upper transverse fracture groove, and having an eye 74 in its opposite end. FIGS. 19 and 20 each show a joining weld 80 whereby the plate body portion 72 is joined to the threaded end portion 70. Preferably, the eye 74 is sized to receive through it at least one vertical rebar member.

FIGS. 21A through 21E illustrate alternative side profiles for fracture grooves 76, 76*b*, 76*c*, 76*d*, or 76*e* and alternative side profiles for fracture grooves 78, 78*b*, 78*c*, 78*d*, or 78*e*.

Figure 22:
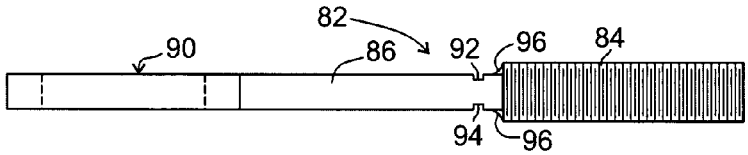
FIG. 22 is side view of a fifth embodiment 82 of the wall bracing wall anchor.
Figure 23:
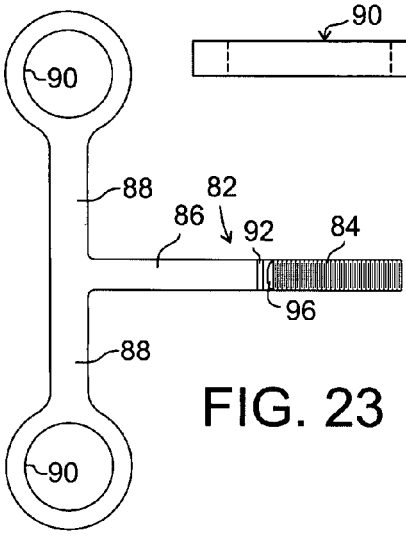
FIG. 23 is a top view of the fifth embodiment 82 of the wall bracing wall anchor.
Figure 24:
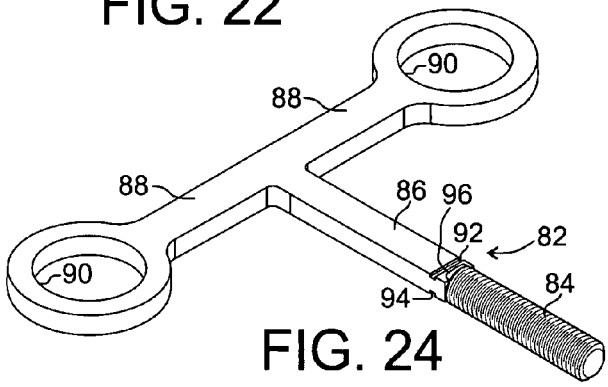
FIG. 24 is a perspective view of the fifth embodiment 82 of the block wall bracing wall anchor.

FIGS. 22 through 24 illustrate a fifth embodiment 82 of the masonry block wall bracing wall anchor showing that the masonry block wall bracing wall anchor can be fabricated in part from plate steel. The fifth embodiment 82 comprises a threaded end portion 84 joined to a first end of a T-shaped plate body portion 86, said T-shaped plate body portion having flat and parallel upper and lower surfaces and having a thickness less than the diameter of said threaded end portion, said first end being the base of the T, said T-shaped plate body having an upper transverse fracture groove 92 in and across said upper surface located near to and perpendicular to the threaded end portion, having a lower transverse fracture groove 94 in said lower surface located closest to, opposite to, and parallel to said upper transverse fracture groove, and said T-shaped plate body portion having in its opposite end two coplanar body portion wings 88 (the arms of the T) and two eyes 90 with one said eye in each said body portion wing spaced from one another on opposite sides of the longitudinal axis of said threaded end portion.

FIGS. 22, 23, and 24 show joining welds 96 whereby the first end of the T-shaped plate body portion 86 is joined to the threaded end portion 84. Preferably, each said eye 90 is sized to receive through it at least one vertical rebar member. Alternative side profiles for fracture grooves such as those shown in FIGS. 21A through 21E could also be formed for use in the fifth embodiment.

Figure 25:
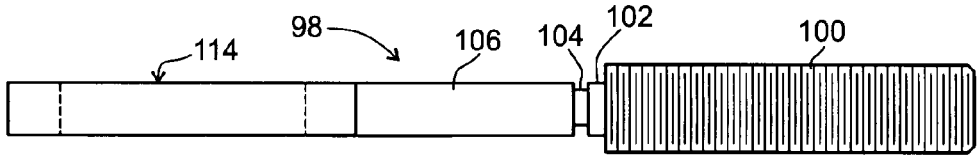
FIG. 25 is side view of a sixth embodiment 98 of the wall bracing wall anchor.
Figure 26:
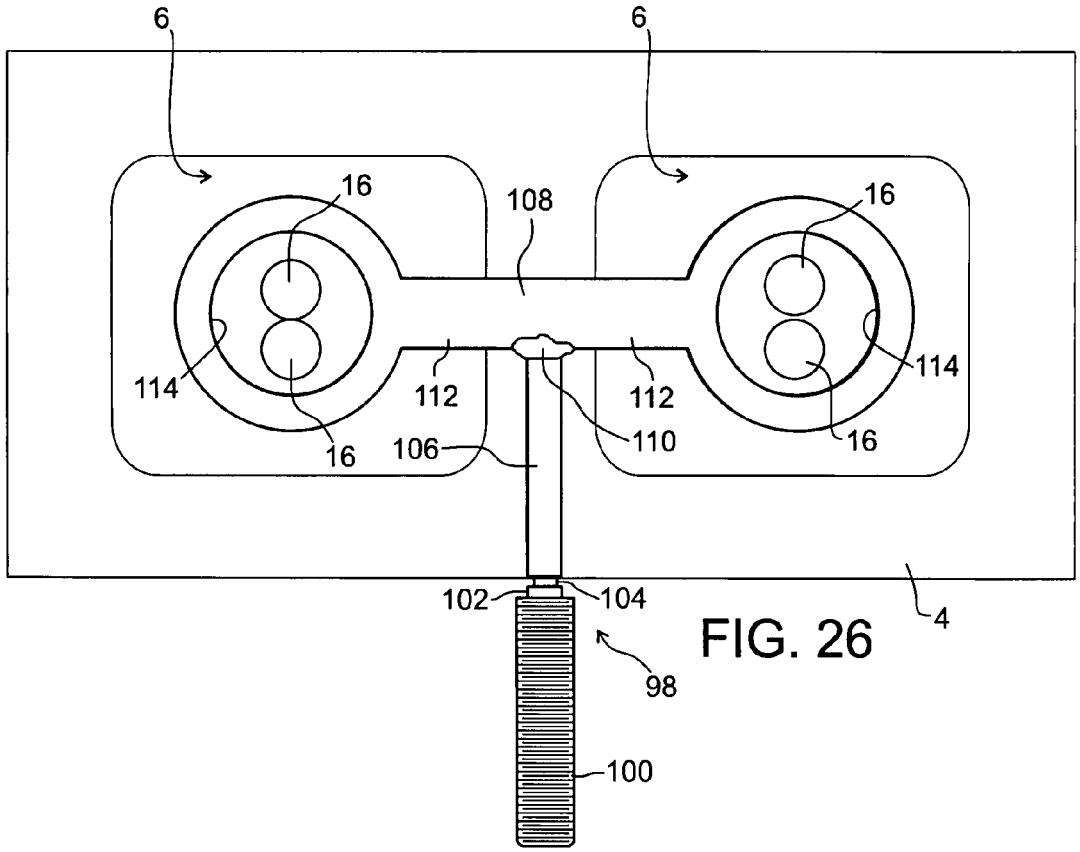
FIG. 26 is a top view of the sixth embodiment 98 of the wall bracing wall anchor.
Figure 27:
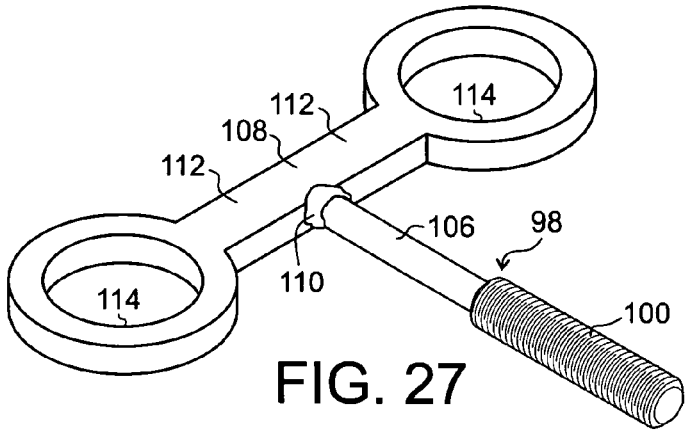
FIG. 27 is a perspective view of the sixth embodiment 98 of the block wall bracing wall anchor.

FIGS. 25 through 27 illustrate a sixth embodiment 98 of the masonry block wall bracing wall anchor illustrating that the masonry block wall bracing wall anchor can be fabricated in part from plate steel. The sixth embodiment 98 comprises a threaded end portion 100 joined to a first cylindrical body portion 102 of a cylindrical connecting shaft having a diameter smaller than the diameter of the threaded end portion and having an annular fracture groove 104 in said shaft between said first cylindrical body portion and a second cylindrical body portion 106 of said connecting shaft, a generally flat eye plate 108 having two horizontally diverging body portion wings 112 with each said body portion wing having an eye 114 at its outer end, and said eye plate joined between said eyes to the end of said second cylindrical body portion away from the annular fracture groove and from the threaded end portion. FIGS. 26 and 27 each show a joining weld 110 whereby said eye plate 108 is joined between said eyes 114 to the end of said second cylindrical body portion 106 away from the annular fracture groove 104 and away from the threaded end portion 100. Preferably, each said eye 114 is sized to receive through it at least one vertical rebar member. Alternative side profiles for fracture grooves such as those shown in FIGS. 21A through 21E could also be formed for use in the sixth embodiment.

FIG. 26 shows a preferable placement during construction of a masonry wall of the sixth embodiment 98 of the masonry wall bracing wall anchor on a masonry block 4 of a lower course of blocks with an outer face of the block aligned through the annular groove 104 and with the first cylindrical body portion 102 and the threaded portion 100 protruding perpendicularly outward from the outer face of the block and related wall. Preferably, the diameter of the connecting shaft is equal to or less than the vertical thickness of the bed joint of the wall.

After the wall is completed, the wall anchor 98 can be fractured through the annular fracture groove 104 by a mason or other worker by use of a simple hand tool a hammer in a similar manner as described above regarding the third embodiment to remove said protruding threaded end portion 100 and said first cylindrical body portion 102.

While FIGS. 25 and 26 show a squared annular fracture groove 104, alternative side profiles for fracture grooves such as those shown in FIG. 21 could also be used with this sixth embodiment. The threaded end portion 100 and the connecting shaft can be forged or machined from a single piece of steel or fabricated separately and joined by welding. FIGS. 26 and 27 show the eye plate 108 joined between the eyes to the end of the second cylindrical body portion 106 away from the annular fracture groove 104 by means of a joining weld 110.

The various embodiments of the present invention may be sized in a range of sizes to advantageously cooperate with the various sizes and dimensions of masonry blocks in construction use.

Each embodiment of the block wall bracing wall anchor invention is preferably made from low to mid-grade steel. Preferably, all embodiments of the masonry block wall bracing wall anchor have rolled threads and all fracture grooves are forged. Alternatively, the fracture grooves could be machined by sawing, milling, grinding, turning, casting, or other suitable machining process. Preferably, each fracture groove will have a selected depth in a range of 5 to 40 percent of the thickness of an immediately adjacent portion of the intermediate body portion, the plate body portion, or the connecting shaft away from the threaded end portion.

The present invention in each of its various embodiments can be used with preferably a washer and a nut to replace prior art wall anchors having threaded attachment points such as the j-bolt wall anchor 18 discussed herein. For example, each of the embodiments 42, 42', 54, 68, 82, or 98 of the masonry block wall bracing wall anchor could substitute for the j-bolt wall anchor and be reversibly connected by a washer and a nut to an upper wall mounting bracket 30 to secure a side support 28 to a wall 2.

The preceding description and exposition of the invention is presented for purposes of illustration and enabling disclosure. It is neither intended to be exhaustive nor to limit the invention to the precise forms disclosed. Modifications or variations in the invention in light of the above teachings that are obvious to one of ordinary skill in the art are considered within the scope of the invention as determined by the appended claims when interpreted to the breath to which they fairly, legitimately and equitably are entitled.

I claim:

1. A masonry block wall bracing wall anchor for emplacing within a masonry block wall having a plurality of bed joints between a plurality of successive courses of masonry blocks for the attaching of a side support comprising a threaded end portion integrally joined to an intermediate body portion having a vertical cross-section generally sized to fit within and substantially bridge the vertical thickness of a bed joint between two successive courses of masonry blocks, said intermediate body portion having flat and parallel upper and lower surfaces, said intermediate body portion integrally joined to an opposite end portion, said opposite end portion having an eye sized to receive through it at least one rebar member, and said intermediate body portion having an upper transverse fracture groove in said upper surface located near said threaded end portion.

2. A masonry block wall bracing wall anchor according to claim 1 wherein said intermediate body portion having a lower transverse fracture groove in said lower surface located closest to, opposite to, and parallel to said upper transverse fracture groove.

3. A masonry block wall bracing wall anchor comprising a threaded end portion integrally joined to an intermediate body portion having flat and parallel upper and lower surfaces and having a thickness less than the diameter of said threaded end portion, said intermediate body portion integrally joined to an opposite end portion, said opposite end portion having an eye sized to receive through it at least one rebar member, and said intermediate body portion having an upper transverse fracture groove in said upper surface located near said threaded end portion.

4. A masonry block wall bracing wall anchor according to claim 3 wherein said intermediate body portion having a lower transverse fracture groove in said lower surface located closest to, opposite to, and parallel to said upper transverse fracture groove.

5. A masonry block wall bracing wall anchor comprising a threaded end portion integrally joined to a first end of a plate body portion, said plate body portion having flat and parallel upper and lower surfaces and having a thickness less than the diameter of said threaded end portion, said plate portion having an eye in its opposite end, said eye sized to receive through it at least one rebar member, and said plate portion haying an upper transverse fracture groove in and across said upper surface located near to and perpendicular to said threaded end portion.

6. A masonry block wall bracing wall anchor according to claim 5 wherein said plate portion having a lower transverse fracture groove in said lower surface located closest to, opposite to, and parallel to said upper transverse fracture groove.

* * * * *